US006971370B2

(12) United States Patent
Suenaga et al.

(10) Patent No.: US 6,971,370 B2
(45) Date of Patent: Dec. 6, 2005

(54) COMMON RAIL TYPE FUEL INJECTION SYSTEM

(75) Inventors: Ryo Suenaga, Kariya (JP); Namoru Oki, Chiryu (JP)

(73) Assignee: DENSO Corporation, Kariya (JP)

( * ) Notice: Subject to any disclaimer, the term of this patent is extended or adjusted under 35 U.S.C. 154(b) by 0 days.

(21) Appl. No.: 10/968,080

(22) Filed: Oct. 20, 2004

(65) Prior Publication Data

US 2005/0081825 A1 Apr. 21, 2005

(30) Foreign Application Priority Data

Oct. 21, 2003 (JP) ..... 2003-361091

(51) Int. Cl.[7] ..... F02M 37/04
(52) U.S. Cl. ..... 123/436; 123/419
(58) Field of Search ..... 123/419, 436, 123/357, 497, 494, 496; 73/119 A

(56) References Cited

U.S. PATENT DOCUMENTS 5,775,304 A * 7/1998 Kono et al. ..... 123/497
6,105,554 A * 8/2000 Nishiyama ..... 123/436
6,293,757 B1 * 9/2001 Oda et al. ..... 417/53
6,694,945 B2 * 2/2004 Kawaguchi et al. ..... 123/299
6,725,837 B2 * 4/2004 Hiraku et al. ..... 123/436
6,755,176 B2 * 6/2004 Takeuchi et al. ..... 123/299
6,779,511 B2 * 8/2004 Tonetti et al. ..... 123/480
2003/0131823 A1 * 7/2003 Asakawa ..... 123/436

FOREIGN PATENT DOCUMENTS

JP A-2003-222046 8/2003

* cited by examiner

*Primary Examiner*—Carl S. Miller
(74) *Attorney, Agent, or Firm*—Nixon & Vanderhye P.C.

(57) ABSTRACT

When a pressure-feeding period of a supply pump and an injection period of an injector overlap and an actual injection quantity is affected by a pump pressure-feeding quantity of fuel supplied by the supply pump, an engine control unit (ECU) calculates the pump pressure-feeding quantity supplied during the injection period and calculates a correction value in accordance with the pump pressure-feeding quantity. The ECU corrects a command injection quantity with the correction value. Thus, even if injection start timing changes in accordance with a change in an operating state and if the pump pressure-feeding quantity supplied during the injection period changes because of the change in the injection start timing, variation in the actual injection quantity can be inhibited. As a result, the injector can inject an optimum quantity of the fuel.

4 Claims, 6 Drawing Sheets

COMMON RAIL TYPE FUEL INJECTION SYSTEM

CROSS REFERENCE TO RELATED APPLICATION

This application is based on and incorporates herein by reference Japanese Patent Application No. 2003-361091 filed on Oct. 21, 2003.

BACKGROUND

1. Field

Exemplary embodiments of the present invention relate to a common rail type fuel injection system. Specifically, the present invention relates to correction control for correcting a change of an injection quantity of fuel injected from an injector, the change being caused by pump pressure-feeding operation (fuel pressure-feeding operation) of a supply pump.

2. Description of Related Art

In the case where pump pressure-feeding operation (fuel pressure-feeding operation) of a supply pump and a fuel injection of an injector are performed not on a one-on-one basis, a common rail pressure at the time when the injection is performed will vary among cylinders. As a result, an actual injection quantity of the fuel actually injected from the injectors will vary among the cylinders. In the case of multi-injection for performing multiple injections in one injection period, the multi-injection is regarded as one injection.

Therefore, control for reading the common rail pressure at the time immediately before the start of the injection by using a rising edge of a driving pulse of the injector as a trigger and for correcting an injection period in accordance with the common rail pressure is performed.

Behavior of the common rail pressure in an injection period in which the supply pump is pressure-feeding the fuel is different from the behavior of the common rail pressure in another injection period in which the supply pump is not pressure-feeding the fuel. More specifically, the behavior of the common rail pressure in the case where a pump pressure-feeding period of the supply pump (a period in which the supply pump pressure-feeds the fuel) and the injection period of the injector overlap is different from the behavior in the case where the pump pressure-feeding period and the injection period do not overlap. Accordingly, the actual injection quantity in the case where the overlap occurs differs from the actual injection quantity in the case where the overlap does not occur. As a result, variation among the cylinders will occur.

Therefore, for instance, in a technology disclosed in Unexamined Japanese Patent Application Publication No. 2003-222046 (Patent Document 1), it is determined whether the overlap between the pump pressure-feeding period and the injection period occurs. If it is determined that the overlap occurs, the injection period is calculated based on a map, which should be used when the overlap occurs. If it is determined that the overlap does not occur, the injection period is calculated based on another map, which should be used when the overlap does not occur.

A pump discharge rate of the supply pump (a quantity of the fuel discharged from the supply pump per unit time) fluctuates because of the operation of the pump such as a cam excursion. The discharge rate changes during the pressure-feeding period. For instance, the discharge rate varies among a time point immediately after the start of the pressure-feeding operation, a time point in the pressure-feeding operation, and a time point immediately before the end of the pressure-feeding operation. For instance, in the case of a supply pump for pressure-feeding the fuel by using a plunger pump driven by a rotating cam, the pump discharge rate of the fuel in one pressure-feeding operation produces a part of a sine curve. The pump discharge rate is not constant.

The technology disclosed in Patent Document 1 determines whether the overlap occurs, and calculates the injection period based on the map, which is used when the overlap occurs, or the map, which is used when the overlap does not occur. However, this technology does not take into account the fact that a pump pressure-feeding quantity of the supply pump changes during the injection period if the injection start timing changes in accordance with a change in the operating state and if the pump discharge rate changes because of the change in the injection start timing. The pump pressure-feeding quantity is a quantity of the fuel supplied from the supply pump to the common rail. Therefore, there is a possibility that the actual injection quantity varies due to the variation of the timing of the overlap between the injection period and the pressure-feeding period.

In the case where two injections are performed during one pressure-feeding period, the pump pressure-feeding quantity of the supply pump achieved before the injection start timing differs from the pump pressure-feeding quantity achieved after the injection start timing. Therefore, also in this case, variation between an actual injection quantity of the prior injection and an actual injection quantity of the posterior injection will occur.

SUMMARY

It is therefore a feature of exemplary embodiments of the present invention to provide a common rail type fuel injection system capable of preventing variation in an actual injection quantity due to a change in a pump discharge rate of a supply pump. Thus, a common rail type fuel injection system having high injection accuracy can be provided.

According to an aspect of exemplary embodiments of the present invention, a common rail type fuel injection system calculates a correction value in accordance with a pump pressure-feeding quantity of fuel supplied from a supply pump to a common rail during an injection period, in which the fuel is injected from an injector. The fuel injection system corrects a command injection quantity or an injection period with the correction value.

Thus, a change in an actual injection quantity of the fuel injected from the injector due to a change in a pump pressure-feeding quantity during the injection period can be prevented, and injection accuracy can be improved.

According to another aspect of exemplary embodiments of the present invention, the injection system includes determining means for determining whether a fuel pressure-feeding period of the supply pump and an injection period of the injector overlap. If it is determined that the fuel pressure-feeding period and the injection period overlap, the command injection quantity or the injection period is corrected.

BRIEF DESCRIPTION OF THE DRAWINGS

Features and advantages of an embodiment will be appreciated, as well as methods of operation and the function of the related parts, from a study of the following detailed description, the appended claims, and the drawings, all of which form a part of this application. In the drawings:

DETAILED DESCRIPTION OF NON-LIMITING EXEMPLARY EMBODIMENTS.

Figure 1:
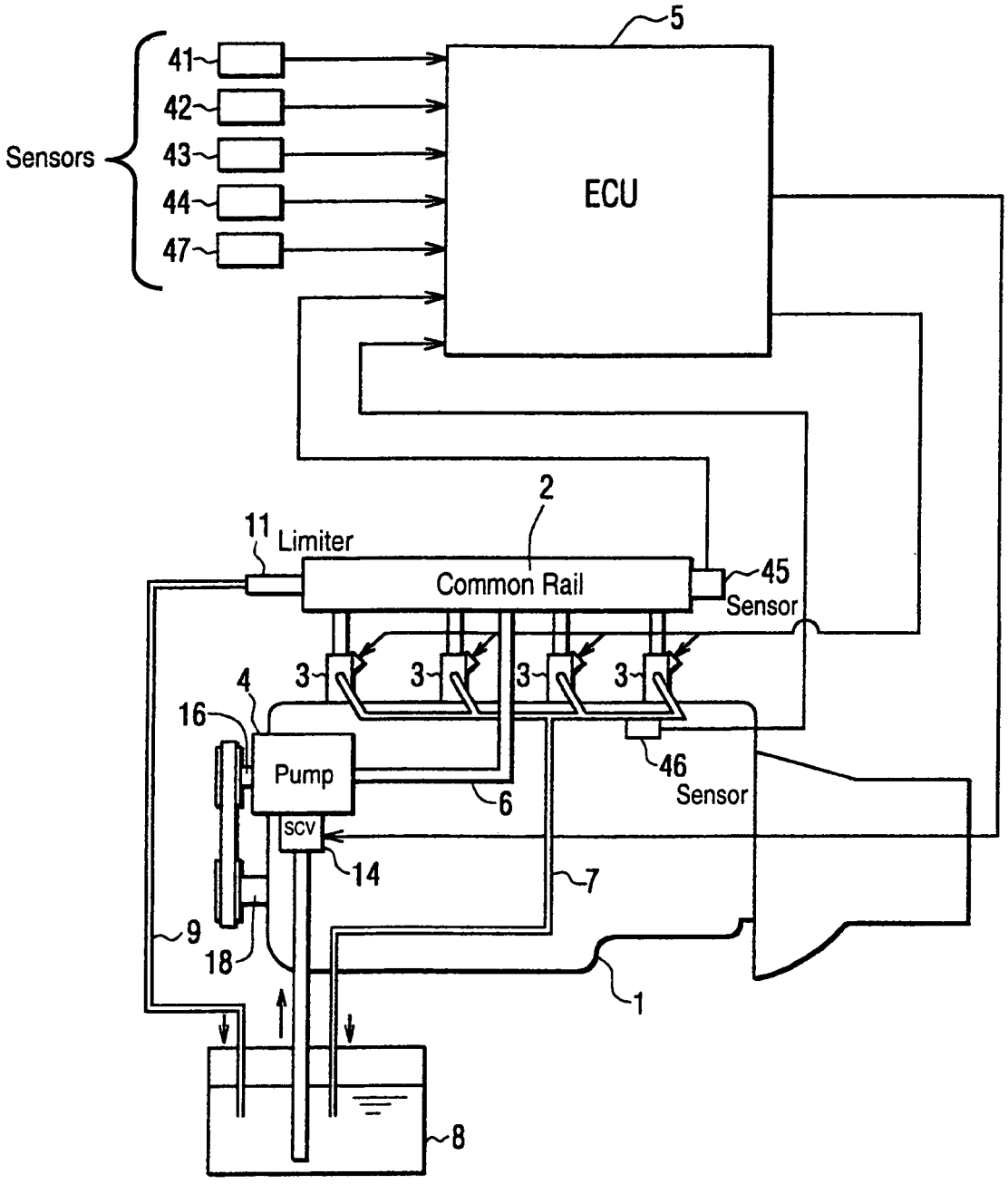
FIG. 1 is a schematic diagram showing a common rail type fuel injection system according to an embodiment of the present invention.

Referring to FIG. 1, a common rail type fuel injection system according to an embodiment of the present invention is illustrated. The fuel injection system shown in FIG. 1 injects fuel into a diesel engine 1. The fuel injection system includes a common rail 2, injectors 3, a supply pump 4, an engine control unit (ECU) 5 and the like.

The common rail 2 is an accumulation vessel for accumulating high-pressure fuel, which is to be supplied to the injectors 3. The common rail 2 is connected to a discharge hole of the supply pump 4, which discharges the high-pressure fuel, through a fuel pipe (a high-pressure fuel passage) 6. Thus, the common rail 2 can continuously accumulate a common rail pressure corresponding to a fuel injection pressure.

Leak fuel from the injectors 3 is returned to a fuel tank 8 through a leak pipe (a fuel return passage) 7.

A pressure limiter 11 as a safety valve is disposed in a relief pipe (a fuel return passage) 9 leading from the common rail 2 to the fuel tank 8. If the fuel pressure in the common rail 2 exceeds a limit set pressure, the pressure limiter 11 opens to limit the pressure in the common rail 2 below the limit set pressure.

The injectors 3 are mounted in cylinders of the engine 1 and inject the fuel into the cylinders respectively. Each injector 3 includes a fuel injection nozzle, an electromagnetic valve and the like. The fuel injection nozzle is connected to a downstream end of one of plural branching pipes branching from the common rail 2, and injects the high-pressure fuel, which is accumulated in the common rail 2, into the cylinder. The electromagnetic valve controls lifting operation of a needle accommodated in the fuel injection nozzle.

Figure 2:
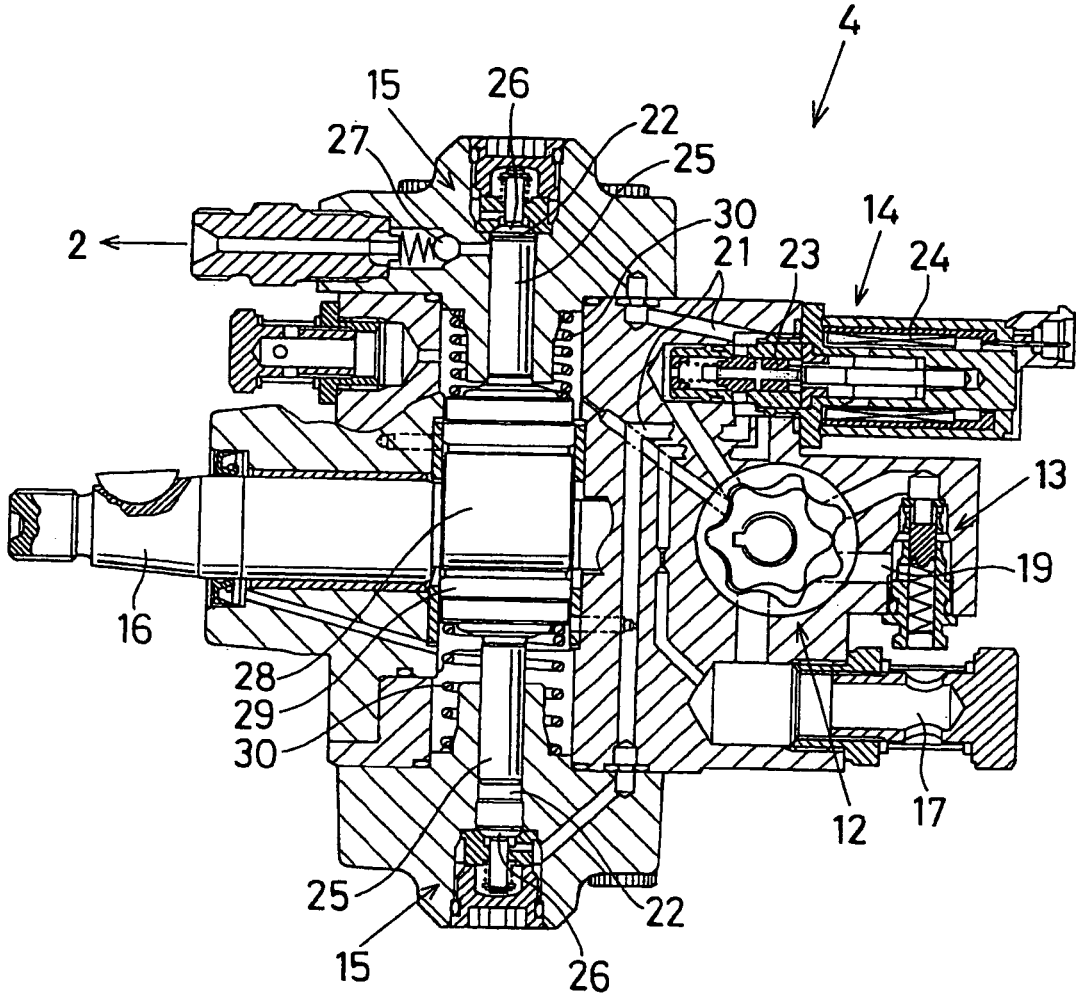
FIG. 2 is a sectional view showing a supply pump of the fuel injection system according to the embodiment.

Next, the supply pump 4 will be explained based on FIG. 2.

The supply pump 4 pressurizes the fuel to a high pressure and supplies the pressurized fuel to the common rail 2. The supply pump 4 includes a feed pump 12, a regulator valve 13, a suction control valve (SCV) 14, and two high-pressure pumps 15 as shown in FIG. 2. In FIG. 2, the feed pump 12 is shown in a state in which the feed pump 12 is rotated by 90°.

The feed pump 12 is a low-pressure feed pump for drawing the fuel from the fuel tank 8 and for feeding the fuel to the high-pressure pumps 15. The feed pump 12 is structured with a trochoid pump, which is rotated by a camshaft 16. If the feed pump 12 is driven, the feed pump 12 feeds the fuel, which is drawn through a fuel inlet 17, to the high-pressure pumps 15 through the SCV 14.

The camshaft 16 is a pump drive shaft and is driven and rotated by a crankshaft 18 of the engine 1 as shown in FIG. 1.

The regulator valve 13 is disposed in a fuel passage 19 connecting a discharge side of the feed pump 12 with a supply side of the feed pump 12. If a discharge pressure of the feed pump 12 increases to a predetermined pressure, the regulator valve 13 opens to prevent the discharge pressure of the feed pump 12 from exceeding the predetermined pressure.

The SCV 14 is disposed in a fuel passage 21, which introduces the fuel from the feed pump 12 to the high-pressure pumps 15. The SCV 14 changes and regulates the common rail pressure by regulating a suction quantity of the fuel drawn into pressurizing chambers (plunger chambers) 22 of the high-pressure pumps 15.

The SCV 14 includes a valve 23 for changing opening degrees of the fuel passages 21 and a linear solenoid 24 for regulating the valve opening degree of the valve 23 based on drive current provided by the ECU 5.

The two high-pressure pumps 15 are plunger pumps for repeating fuel drawing operation and fuel pressurizing operation in respective cycles, which are deviated from each other by a phase of 180°. The two high-pressure pumps 15 pressurize the fuel supplied through the SCV 14 to a high pressure and supply the fuel to the common rail 2. Each high-pressure pump 15 includes a plunger 25, a suction valve 26 and a discharge valve 27. The plunger 25 is reciprocated by the camshaft 16. The suction valve 26 supplies the fuel to the pressurizing chamber 22, whose volume is changed by the reciprocation of the plunger 25. The discharge valve 27 discharges the fuel pressurized in the pressurizing chamber 22 to the common rail 2.

A cam ring 29 is fitted around a periphery of an eccentric cam 28 of the camshaft 16. Each plunger 25 is pressed against the cam ring 29 by a spring 30. If the camshaft 16 rotates, the plunger 25 reciprocates in accordance with eccentric motion of the cam ring 29.

If the plunger 25 descends and the pressure in the pressurizing chamber 22 decreases, the discharge valve 27 closes and the suction valve 26 opens. Thus, the fuel regulated by the SCV 14 is supplied into the pressurizing chamber 22.

If the plunger 25 ascends and the pressure in the pressurizing chamber 22 increases, the suction valve 26 closes. If the pressure of the fuel pressurized in the pressurizing chamber 22 reaches a predetermined pressure, the discharge valve 27 opens and the high-pressure fuel pressurized in the pressurizing chamber 22 is discharged to the common rail 2.

The camshaft 16 makes one revolution while the crankshaft 18 makes two revolutions. A cycle in which the crankshaft 18 makes two revolutions and the injectors 3 of the four cylinders inject the fuel once for each injector 3 is synchronized with the cycle in which the camshaft 16 makes one revolution. In the present embodiment, the fuel injections are performed sequentially in the second cylinder #2, the first cylinder #1, the third cylinder #3 and the fourth cylinder #4 in that order.

Figure 3:
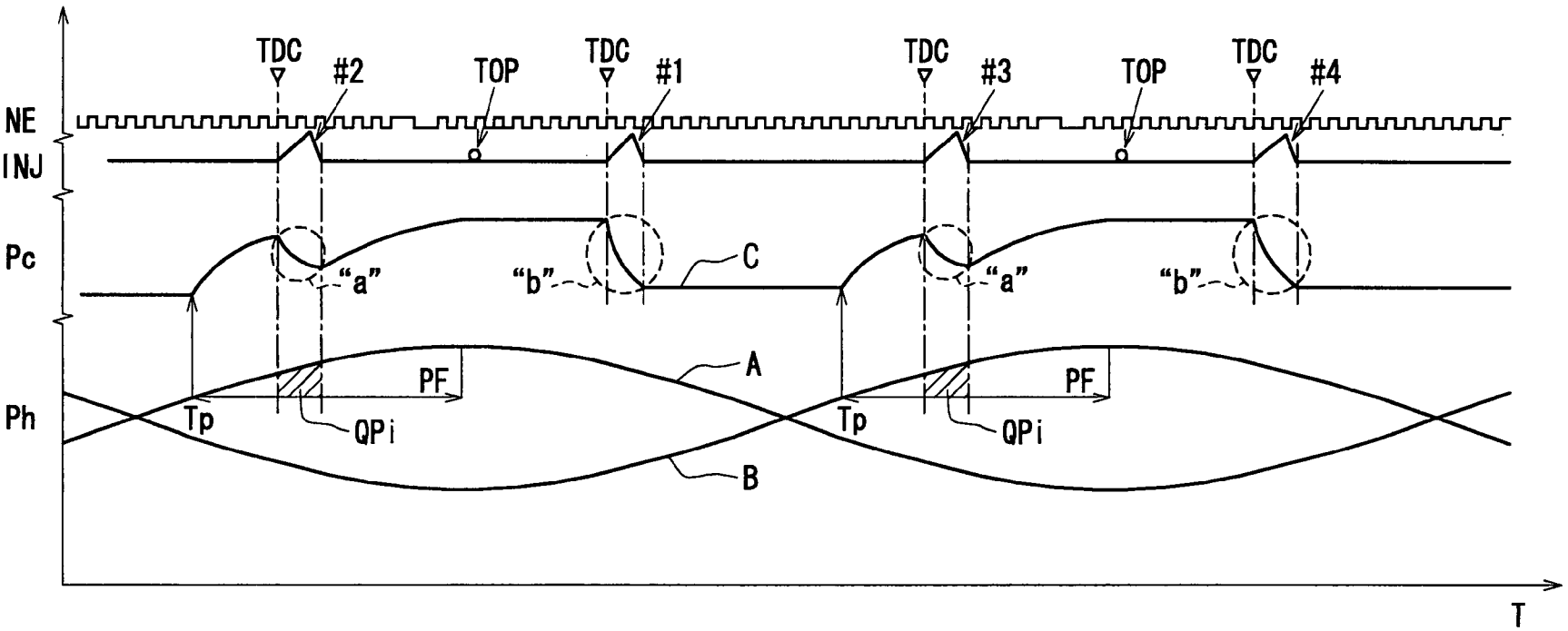
FIG. 3 is a time chart showing injection timing of injectors and an operation of the supply pump of the fuel injection system according to the embodiment.

The two high-pressure pumps 15 are disposed so that the phases thereof are deviated from each other by 180° with respect to the rotational axis of the camshaft 16. The eccentric cam 28 is common to the two high-pressure pumps 15. Therefore, while the camshaft 16 makes one revolution, one of the two high-pressure pumps 15 performs the fuel pressure-feeding operation and the fuel drawing operation as shown by a solid line A in FIG. 3, and the other one of the high-pressure pumps 15 performs the fuel pressure-feeding operation and the fuel drawing operation in a phase deviated from that of the one of the high-pressure pumps 15 by 180° as shown by a solid line B in FIG. 3. The solid line A in FIG. 3 represents a cam phase Ph of the one of the high-pressure pumps 15, and the solid line B in FIG. 3 represents a cam phase Ph of the other one of the high-pressure pumps 15.

The ECU 5 has functions of CPU for performing control processing and calculation processing, a memory device (a memory such as ROM, standby RAM, EEPROM and RAM) for storing various types of programs and data, an input circuit, an output circuit, a power source circuit, an injector drive circuit, a pump drive circuit and the like. The ECU 5 performs various types of calculation processing based on sensor signals (engine parameters: signals corresponding to a manipulating state of a vehicle occupant, an operating state of the engine 1, and the like) inputted to the ECU 5.

The ECU 5 is connected with the sensors such as an accelerator position sensor 41 for sensing an accelerator position ACCP, a rotation speed sensor 42 for sensing engine rotation speed NE, a cooling water temperature sensor 43 for sensing temperature of cooling water of the engine 1, intake air temperature sensor 44 for sensing temperature of intake air taken into the engine 1, a rail pressure sensor 45 for sensing the common rail pressure Pc, fuel temperature sensor 46 for sensing temperature F of the fuel supplied to the injectors 3, and other sensors 47.

As explained above, in the present embodiment, each time the camshaft 16 makes one revolution and the one of the high-pressure pumps 15 performs the fuel pressure-feeding operation and the fuel drawing operation and the other one of the high-pressure pumps 15 performs the fuel pressure-feeding operation and the fuel drawing operation in the phase deviated from that of the one of the high-pressure pumps 15 by 180°, the injectors 3 inject the fuel into the four cylinders respectively, once for each injector 3. At that time, the injectors 3 sequentially perform the injections in the second cylinder #2, the first cylinder #1, the third cylinder #3 and the fourth cylinder #4 in that order as shown by protrusions #2, #1, #3, #4 of a solid line INJ in FIG. 3. The solid line INJ represents the injection quantity of the fuel injected into the first to fourth cylinders #1–#4. A solid line NE represents a pulse outputted by the rotation speed sensor 42. Each one of time points "TDC" in FIG. 3 corresponds to a top dead center position of each one of the cylinders #1–#4. Each one of time points "TOP" in FIG. 3 corresponds to a cam top of the high-pressure pump 15. Each one of areas QPi indicates an injection period pump pressure-feeding quantity of the fuel, which is pressure-fed from the supply pump 4 to the common rail 2 during the injection period. Each one of time points Tp indicates start timing of the pump pressure-feeding operation of the supply pump 4.

As shown in FIG. 3, the injector 3 of the second cylinder #2 or the third cylinder #3 injects the fuel in a period PF, in which the supply pump 15 pressure-feeds the fuel. However, the injector 3 of the first cylinder #1 or the fourth cylinder #4 injects the fuel in another period in which the supply pump 4 does not pressure-feed the fuel.

In such a case, when the injection is performed in the first cylinder #1 or the fourth cylinder #4, the common rail pressure Pc is only decreased because of the fuel injection performed by the injector 3 as shown in areas "b" of a solid line C in FIG. 1. When the injection is performed in the second cylinder #2 or the third cylinder #3, the common rail pressure Pc is decreased because of the fuel injection performed by the injector 3, and is affected by the supply pressure applied by the supply pump 4 as shown in areas "a" of the solid line C in FIG. 3.

Thus, the supply pump 4 does not perform the pressure-feeding operation when the fuel injection is performed in the first cylinder #1 or the fourth cylinder #4. More specifically, the pressure-feeding period of the supply pump 4 and the injection period of the injector 3 of the first cylinder #1 or the fourth cylinder #4 do not overlap. The supply pump 4 performs the pressure-feeding operation when the fuel injection is performed in the second cylinder #2 or the third cylinder #3. More specifically, the pressure-feeding period of the supply pump 4 and the injection period of the injector 3 of the second cylinder #2 or the third cylinder #3 overlap.

Therefore, the actual injection quantity of the fuel injected from the injectors 3 will vary if the injection control of the first cylinder #1 and the fourth cylinder #4, in which the overlap does not occur, is performed in the same way as the injection control of the second cylinder #2 and the third cylinder #3, in which the overlap occurs. It is because the common rail pressure Pc is fluctuated by the presence or absence of the overlap between the pressure-feeding period of the supply pump 4 and the injection period of the injector 3.

In contrast, the ECU 5 of the present embodiment includes determining means and pump pressure-feeding quantity correcting means, in addition to injector controlling means. The injector controlling means calculates injection start timing Ti and a command injection quantity Q in accordance with the present operating state and controls the opening and closing of the injectors 3 so that the command injection quantity Q is achieved at the injection start timing Ti. The determining means determines whether the overlap occurs. The pump pressure-feeding quantity correcting means corrects the command injection quantity Q if the determining means determines that the overlap occurs.

The injector controlling means is a control program for calculating the injection start timing Ti and the command injection quantity Q in accordance with the present operating state based on maps or equations stored in the ROM and the engine parameters inputted to the RAM for each fuel injection and for controlling the opening and closing of the injectors 3 so that the command injection quantity Q is achieved at the injection start timing Ti. The program of the injector controlling means is stored in the ROM of the ECU 5.

The determining means is a control program for determining whether the pressure-feeding period of the supply pump 4 and the injection period of the injector 3 overlap. The program of the determining means is stored in the ROM of the ECU 5.

The pump pressure-feeding quantity correcting means operates when the determining means determines that the overlap occurs. The pump pressure-feeding quantity correcting means is a control program for calculating a correction value Qc in accordance with the injection period pump pressure-feeding quantity QPi of the fuel pressure-fed from the supply pump 4 to the common rail 2 during the injection period, in which the injector 3 injects the fuel, and for correcting the command injection quantity Q with the correction value Qc. Then, the pump pressure-feeding quantity correcting means calculates the injection period TQ from the corrected command injection quantity Q. The program of the pump-pressure feeding quantity correcting means is stored in the ROM of the ECU 5.

Figure 4:
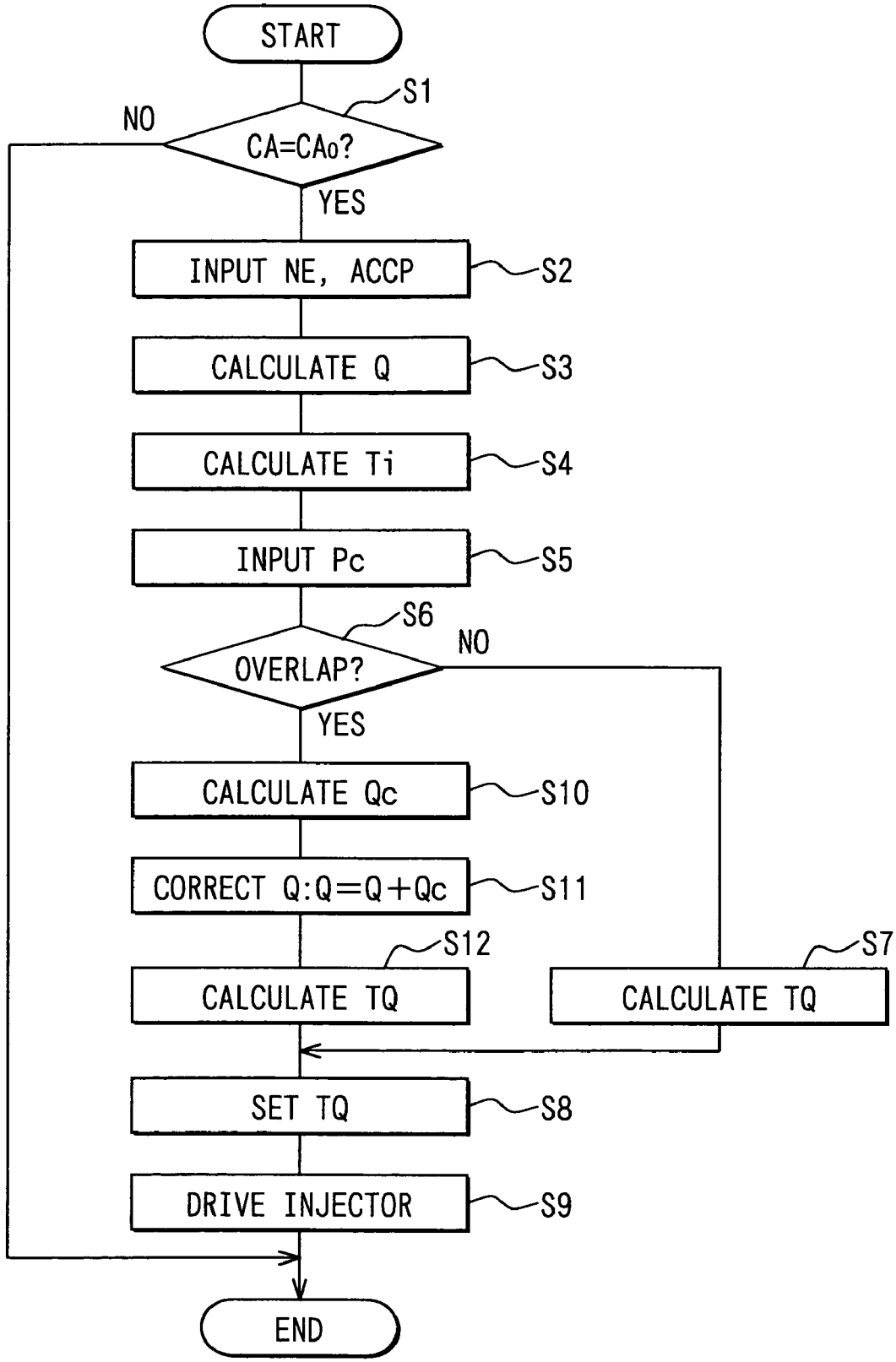
FIG. 4 is a flowchart showing injector control performed by an engine control unit of the fuel injection system according to the embodiment.

Next, control performed by the injector controlling means including the determining means and the pump pressure-feeding quantity correcting means will be explained based on a flowchart shown in FIG. 4. Steps from Step S1 to Step S5 and steps from Step S7 to Step S9 of the flowchart of FIG. 4 correspond to basic control of the injector controlling means. Step S6 corresponds to the determining means. Steps from Step S10 to Step S12 correspond to correction control performed by the pump pressure-feeding quantity correcting means.

First, in Step S1, it is determined whether a crank angle CA of the engine 1 is at a control standard position $CA_0$ for performing fuel injection control processing. If the result of the determination in Step S1 is "NO", the processing ends and returns to the start.

If the result of the determination in Step S1 is "YES", the engine rotation speed NE and the accelerator position ACCP are inputted in Step S2.

Then, the command injection quantity Q is calculated from the engine rotation speed NE and the accelerator position ACCP based on maps or equations in Step S3.

Then, the injection start timing Ti is calculated from the engine rotation speed NE and the accelerator position ACCP based on maps or equations in Step S4.

Then, the common rail pressure Pc is inputted in Step S5.

Then, in Step S6, it is determined whether the fuel pressure-feeding period of the supply pump 4 and the injection period of the injector 3 overlap in a specific cylinder, into which the fuel is injected. More specifically, it is determined whether the specific cylinder, into which the fuel is injected, is one of the second cylinder #2 and the third cylinder #3, in which the fuel pressure-feeding period of the supply pump 4 and the injection period of the injector 3 overlap.

If the result of the determination in Step S6 is "NO", the injection period TQ (the length of the injector driving pulse) is calculated from the command injection quantity Q calculated in Step S3 and the common rail pressure Pc inputted in Step S5 based on maps or equations in Step S7.

Then, the injection period TQ is set at an output stage in Step S8. Then, the fuel is injected from the injector 3 by energizing the electromagnetic valve of the injector 3 at the injection start timing Ti (calculated in Step S4) for the injection period TQ set at the output stage. Then, the processing ends once and returns to the start.

If the result of the determination in Step S6 is "YES", the correction value Qc is calculated in accordance with the injection period pump pressure-feeding quantity QPi of the fuel pressure-fed from the supply pump 4 to the common rail 2 during the injection period, in which the fuel is injected from the injector 3, based on maps or equations in Step S10.

Then, in Step S11, the command injection quantity Q calculated in Step S3 is corrected with the correction value Qc calculated in Step S10.

Then, in Step S12, the injection period TQ is calculated in accordance with the injection quantity Q corrected in Step S11 and the common rail pressure Pc inputted in Step S5, based on maps or equations. Then, the processing proceeds to Step S8.

Figure 5:
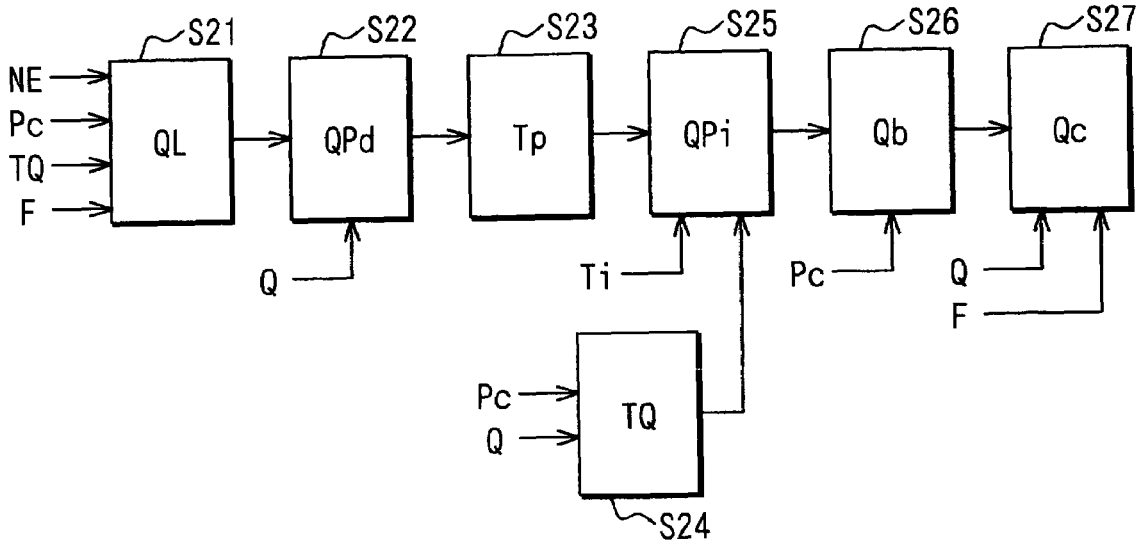
FIG. 5 is a block diagram showing correction value calculation control performed by the engine control unit according to the embodiment.

Next, the control in Step S10 of the flowchart of FIG. 4 for calculating the correction value Qc in the correction control performed by the pump pressure-feeding quantity correcting means will be explained based on a block diagram shown in FIG. 5.

First, in Step S21, the leak quantity QL of the fuel leaking from the injectors 3 is calculated from the operating state such as the engine rotation speed NE, the common rail pressure Pc, the injection period TQ, which is calculated from the command injection quantity Q and the common rail pressure Pc as in Step S7, and the fuel temperature F.

Then, in Step S22, a fuel pressure-feeding quantity (a pump demand pressure-feeding quantity) QPd, which the supply pump 4 is required to discharge, is calculated by adding the command injection quantity Q calculated in Step S3 of the basic control to the leak quantity QL calculated in Step S21.

Then, in Step S23, start timing Tp of the pressure-feeding operation of the supply pump 4 (a pump pressure-feeding operation start position Tp) is calculated form the pump demand pressure-feeding quantity QPd calculated in Step S22. In Step S23, the pump pressure-feeding operation start position Tp may be calculated from the pump demand pressure-feeding quantity QPd and a map prepared in advance. Alternatively, the pump pressure-feeding operation start position Tp may be calculated from the pump demand pressure-feeding quantity QPd and a geometric equation based on a cam excursion of the eccentric cam 28 such as a change in the stroke of the plunger 25 and the shape of the plunger 25 such as a pressurizing area.

Then, in Step S24, the injection period TQ is calculated from the command injection quantity Q calculated in Step S3 of the basic control and the common rail pressure Pc as in Step S7 of the basic control.

Then, in Step S25, the injection period pump pressure-feeding quantity QPi of the fuel supplied from the supply pump 4 to the common rail 2 during the actual injection period is calculated based on the pump pressure-feeding operation start position Tp calculated in Step S23, the actual injection period TQ calculated in Step S24, and the injection start timing Ti calculated in Step S4 of the basic control.

Then, in Step S26, a basic correction value Qb for compensating for a change in the injection quantity caused by the supply pressure of the fuel supplied from the supply pump 4 to the common rail 2 during the injection period is calculated from the injection period pump pressure-feeding quantity QPi calculated in Step S25, the common rail pressure Pc and the like.

Then, in Step S27, the final correction value Qc is calculated by correcting the basic correction value Qb calculated in Step S26 with the command injection quantity Q calculated in Step S3 of the basic control, the fuel temperature F and the like.

Then, in Step S11 of the correction control, the command injection quantity Q is corrected with the correction value Qc calculated in Step S27. Then, in Step S12 of the correction control, the injection period TQ is calculated based on the corrected command injection quantity Q.

Figure 6:
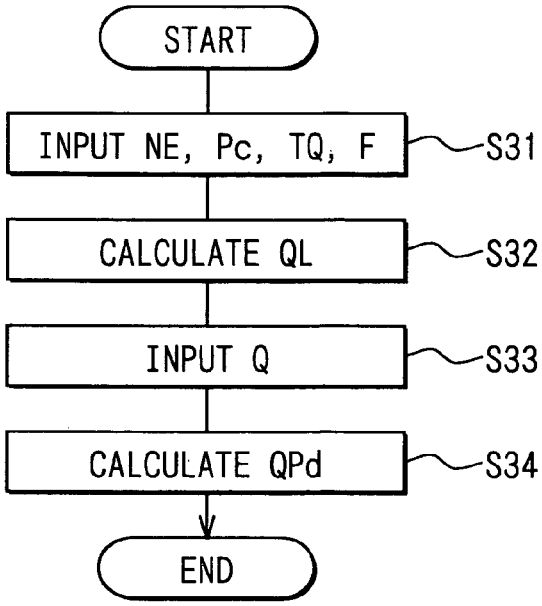
FIG. 6 is a flowchart showing pump demand pressure-feeding quantity calculation control performed by the engine control unit according to the embodiment.

Next, control for calculating the pump demand pressure-feeding quantity QPd performed in Step S21 and Step S22 of the above-explained control for calculating the correction value Qc will be explained based on a flowchart shown in FIG. 6.

First, in Step S31, the engine rotation speed NE, the common rail pressure Pc, the injection period TQ and the fuel temperature F are inputted.

Then, in Step S32, the leak quantity QL of the fuel leaking from the injectors 3 is calculated in accordance with the engine rotation speed NE, the common rail pressure PC, the injection period TQ and the fuel temperature F, based on maps or equations.

Then, the command injection quantity Q calculated in Step S3 of the basic control is inputted in Step S33.

Then, in Step S34, the pump demand pressure-feeding quantity QPd is calculated by adding the leak quantity QL calculated in Step S32 to the command injection quantity Q inputted in Step S33.

Thus, the pump demand pressure-feeding quantity QPd can be calculated.

Figure 7:
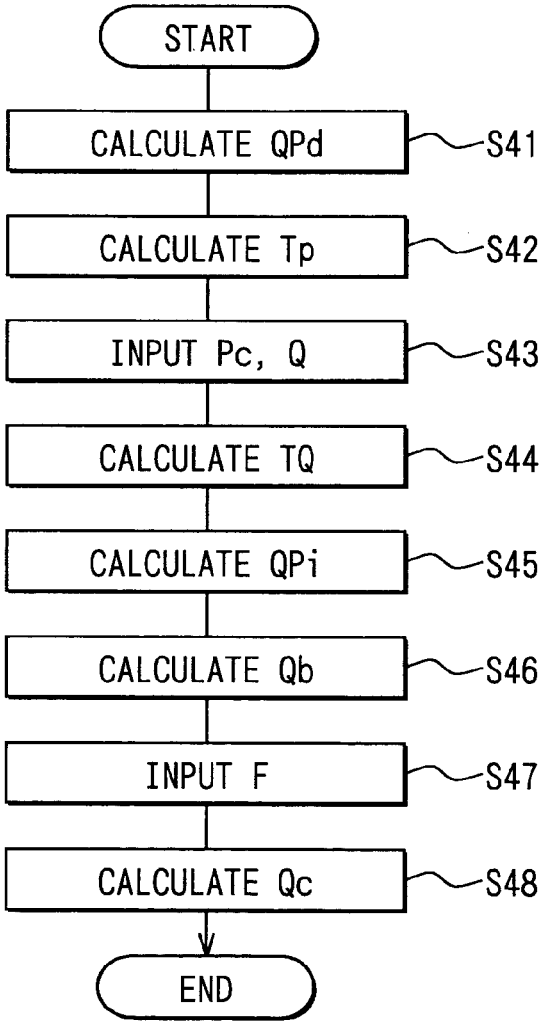
FIG. 7 is a flowchart showing the correction value calculation control performed by the engine control unit according to the embodiment.

Next, control performed in Step S22 and following steps for calculating the correction value Qc will be explained based on a flowchart shown in FIG. 7.

First, in Step S41, the pump demand pressure-feeding quantity QPd is calculated through the control performed in the steps from Step S31 to Step S34.

Then, in Step S42, the pump pressure-feeding operation start position Tp is calculated from the pump demand pressure-feeding quantity QPd calculated in Step S41.

Then, in Step S43, the command injection quantity Q calculated in Step S3 of the basic control and the common rail pressure Pc are inputted. Then, in Step S44, the injection period TQ is calculated from the command injection quantity Q and the common rail pressure Pc.

Then, in Step S45, the injection period pump pressure-feeding quantity QPi is calculated based on the pump pressure-feeding operation start position Tp calculated in Step S42, the injection period TQ calculated in Step S44 and the injection start timing Ti calculated in Step S4 of the basic control.

Then, in Step S46, the basic correction value Qb is calculated from the injection period pump pressure-feeding quantity QPi calculated in Step S45 and the common rail pressure Pc. The basic correction value Qb corresponds to a change in the injection quantity caused by the supply pressure of the fuel supplied from the supply pump 4 to the common rail 2 during the injection period.

Then, in Step S47, the fuel temperature F is inputted.

Then, in Step S48, the final correction value Qc for correcting the command injection quantity Q is calculated by correcting the basic correction value Qb with the command injection quantity Q calculated in Step S3 of the basic control, the fuel temperature F and the like.

As explained above, if it is determined that the pressure-feeding period of the supply pump 4 and the injection period of the injector 3 overlap, the common rail type fuel injection system of the present embodiment calculates the correction value Qc in accordance with the injection period pump pressure-feeding quantity QPi of the fuel supplied from the supply pump 4 to the common rail 2 during the injection period, and corrects the command injection quantity Q with the correction value Qc.

More specifically, the fuel pressure-feeding period of the supply pump 4 and the injection period of the injector 3 of the second cylinder #2 or the third cylinder #3 overlap as shown in FIG. 3. Therefore, the ECU 5 determines that the overlap occurs when the injection is performed in the second cylinder #2 or the third cylinder #3. The injection in the second cylinder #2 or the third cylinder #3 is affected by the injection period pump pressure-feeding quantity QPi.

Therefore, if it is determined that the cylinder in which the injection is performed is the second cylinder #2 or the third cylinder #3, or if it is determined that the overlap occurs, the ECU 5 of the present embodiment calculates the injection period pump pressure-feeding quantity QPi. Then, the ECU 5 calculates the correction value Qc in accordance with the injection period pump pressure-feeding quantity QPi and corrects the command injection quantity Q with the correction value Qc. Therefore, the actual injection quantity is not affected by the presence or absence of the overlap. Moreover, even if the injection start timing changes in accordance with the change in the operation state and if the injection period pump pressure-feeding quantity Qpi during the injection period changes because of the change in the injection start timing, generation of the variation in the actual injection quantity can be inhibited. Thus, highly accurate fuel injection can be performed. As a result, the quantity of the fuel injected from the injector 3 can be optimized in accordance with the operating state of the engine 1.

(Modifications)

In the above embodiment, the injection period pump pressure-feeding quantity QPi is calculated first, and then, the correction value Qc is calculated from the injection period pump pressure-feeding quantity QPi. Alternatively, the correction value Qc corresponding to the injection period pump pressure-feeding quantity QPi may be calculated directly in accordance with the operating state of the engine 1 based on maps or equations.

In the above embodiment, the command injection quantity Q is corrected. Alternatively, the injection period TQ may be corrected. In this case, for instance, a command injection period is calculated in accordance with the command injection quantity Q first, and then, a correction value (a correction injection period) for correcting the injection period is calculated in accordance with the injection period pump pressure-feeding quantity QPi. Thus, the command injection period can be corrected with the correction value (the correction injection period). Also in this case, an effect similar to the effect of the above embodiment can be achieved.

In the above embodiment, the present invention is applied to the common rail type fuel injection system performing two pressure-feeding operations while the system performs four injections in one cycle. Alternatively, the present invention may be applied to a common rail type fuel injection system, which performs other number of pressure-feeding operations and injections in one cycle. More specifically, the present invention may be applied to a common rail type fuel injection system employing other mode of the pressure-feeding operation and the fuel injection such as a mode of performing two pressure-feeding operations and six injections in one cycle, or a mode of performing three pressure-feeding operations and six injections in one cycle.

In the above embodiment, the present invention is applied to the common rail type fuel injection system, in which presence or absence of the overlap can affect the actual injection quantity. Even in the case of a common rail type fuel injection system in which the presence or absence of the overlap does not affect the actual fuel injection quantity, the present invention can be applied to the fuel injection system if the timing of the overlap changes during the pressure-feeding operation, or if multiple injections (for instance, two injections) are performed during one pressure-feeding operation. Thus, the variation in the actual injection quantity due to a difference in the injection start timing in the pressure-feeding period can be prevented. More specifically, the variation in the actual injection quantity can be prevented even if the injection start timing varies among an early stage of the start of the pressure-feeding operation, a middle of the pressure-feeding operation, and a later stage of the pressure-feeding operation.

The present invention should not be limited to the disclosed embodiment, but may be implemented in many other ways without departing from the spirit of the invention.

What is claimed is:

1. A common rail type fuel injection system of an internal combustion engine, the fuel injection system comprising:

a common rail for accumulating high-pressure fuel;

an injector for injecting the fuel accumulated in the common rail;

a supply pump for pressurizing the fuel and for supplying the fuel to the common rail using a plunger reciprocated by a camshaft; and a control device for calculating injection start timing and a command injection quantity in accordance with an operating state of the engine and for controlling opening and closing of the injector based on the injection start timing and the command injection quantity, wherein the control device includes pump pressure-feeding quantity correcting means for calculating a correction value in accordance with a pump pressure-feeding quantity of the fuel, wherein the pump pressure-feeding quantity of the fuel is determined based on a discharge rate of the supply pump and is supplied from the supply pump to the common rail during an injection period in which the injector injects the fuel, and for correcting the command injection quantity or an injection period, which is calculated based on the command injection quantity, with the correction value.

2. The common rail type fuel injection system as in claim 1, wherein the control device includes determining means for determining whether a fuel pressure-feeding period of the supply pump, in which the supply pump supplies the fuel to the common rail, and the injection period of the injector overlap, and the pump pressure-feeding quantity correcting means operates when the determining means determines that the fuel pressure-feeding period and the injection period overlap.

3. A method of operating a common rail type fuel injection system of an internal combustion engine, wherein the fuel injection system comprises a common rail for accumulating high-pressure fuel; an injector for injecting the fuel accumulated in the common rail; and a supply pump for pressurizing the fuel and for supplying the fuel to the common rail using a plunger reciprocated by a camshaft, the method comprising:

calculating injection start timing and a command injection quantity in accordance with an operating state of the engine, and controlling opening and closing of the injector based on the injection start timing and the command injection quantity;

calculating a correction value in accordance with a pump pressure-feeding quantity of the fuel, wherein the pump pressure-feeding quantity of the fuel is determined based on a discharge rate of the supply pump and is supplied from the supply pump to the common rail during an injection period in which the injector injects the fuel; and correcting the command injection quantity or an injection period, which is calculated based on the command injection quantity, with the correction value.

4. The method as in claim 3, further comprising determining whether a fuel pressure-feeding period of the supply pump, in which the supply pump supplies the fuel to the common rail, and the injection period of the injector overlap, wherein the correction value is calculated and the command injection quality or the injection period is corrected when a determination is made that the fuel pressure-feeding period and the injection period overlap.

* * * * *

UNITED STATES PATENT AND TRADEMARK OFFICE

CERTIFICATE OF CORRECTION

PATENT NO. : 6,971,370 B2
DATED : December 6, 2005
INVENTOR(S) : Suenaga et al.

It is certified that error appears in the above-identified patent and that said Letters Patent is hereby corrected as shown below:

Title page,
Item [75], Inventors, change "Namoru Oki" to -- Mamoru Oki --.

Signed and Sealed this

Eighteenth Day of April, 2006

JON W. DUDAS
*Director of the United States Patent and Trademark Office*